US006159302A

United States Patent [19]

Xavier et al.

[11] Patent Number: 6,159,302

[45] Date of Patent: Dec. 12, 2000

[54] NEUTRAL PHOSPHATE PRE-COAGULANT COMPOSITION FOR CLARIFICATION IN WHITE SUGAR PRODUCTION

[75] Inventors: Carlos Roberto Xavier, Araraquara; Claudio Candido Luiz, Cotia; Luiz Antonio Fernandes, Sao Paulo, all of Brazil

[73] Assignee: BetzDearborn Inc., Trevose, Pa.

[21] Appl. No.: 09/231,384

[22] Filed: Jan. 13, 1999

[51] Int. Cl.[7] ..... C13D 3/16

[52] U.S. Cl. ..... 127/57; 252/181; 210/728

[58] Field of Search ..... 127/57; 210/728; 252/181

[56] References Cited

U.S. PATENT DOCUMENTS

| | | | |
|---|---|---|---|
| 3,418,165 | 12/1968 | Rabe . | |
| 3,476,597 | 11/1969 | Lippe et al. . | |
| 3,808,050 | 4/1974 | Paley . | |
| 3,909,287 | 9/1975 | Rundell et al. . | |
| 3,926,662 | 12/1975 | Rundell et al. . | |
| 3,994,743 | 11/1976 | Paley . | |
| 4,039,348 | 8/1977 | Hunwick . | |
| 4,081,288 | 3/1978 | Torres . | |
| 4,492,601 | 1/1985 | Nakasone et al. . | |
| 4,499,112 | 2/1985 | Miller et al. . | |
| 4,523,959 | 6/1985 | Exertier . | |
| 4,655,934 | 4/1987 | Rose et al. | 210/728 |
| 4,765,867 | 8/1988 | Dreisbach et al. . | |
| 5,110,363 | 5/1992 | Clarke et al. . | |
| 5,554,227 | 9/1996 | Kwok et al. . | |
| 5,891,254 | 4/1999 | Coville et al. | 127/48 |

OTHER PUBLICATIONS

1998:761841 CAPLUS, Gibson et al, "Modified magnesium hydroxide slurry . . . ", Nov. 5, 1998.

1987:578508 CAPLUS, Zakharov et al, "Clarifying of saturation juice . . . ", Oct. 8, 1984.

1992:492558 CAPLUS, Perez et al, "Effect of chemical reagents added . . . ", 1990.

*Primary Examiner*—David Brunsman
*Attorney, Agent, or Firm*—Greenblum & Bernstein, P.L.C.

[57] ABSTRACT

Methods and compositions for clarifying sugar are disclosed. Compositions of a condensation polymer of a dihaloalkyl compound and a dialkylamine compound and a phosphate compound are effective at clarifying the sugar syrup during its production as well as reducing the total amount of phosphate used.

20 Claims, No Drawings

NEUTRAL PHOSPHATE PRE-COAGULANT COMPOSITION FOR CLARIFICATION IN WHITE SUGAR PRODUCTION

FIELD OF THE INVENTION

The present invention provides for methods and compositions for clarifying sugar solutions while lowering the amount of phosphate-based compound employed.

BACKGROUND OF THE INVENTION

After sugar is extracted from prepared cane, the resultant mixed juice (water, sucrose and other impurities) needs to be clarified. In the production of white sugar, this clarification is important as the better the clarification of the sugar juice, the better (i.e., more white) the final sugar will be.

The coagulation of the impurities in this stream is very important in achieving a good end product. After the clarification stage, the evaporation stage takes place. Any impurities present causing color problems in the liquid also get concentrated in the same proportion as the sugar juice does. Color levels of up to 6,000 to 10,000 ICUMSA color units are often obtained in this stage.

As such, a majority of sugar mills will clarify the sugar syrup after the evaporation stage. This process is typically accomplished by pre-coagulating the sugar syrup and passing it through a flotation system.

If phosphoric acid is used as the phosphate source in the pre-coagulation step, lime or calcium sacharate is used to neutralize this and maintain the pH of the sugar syrup in the neutral range to avoid sugar inversion.

This neutralization step can be a complicated operation due to solids level content. Sugar syrup can have 60 to 70% solids content and these can deposit over the pH meter's electrodes reducing its sensitivity and causing pH variations. These variations in pH can cause the color of the clarified syrup to be higher than before the clarification step. This substantially compromises the quality of the final sugar.

Additional complications arise due to the sugar syrup's high concentration. This high concentration causes lime dissolution to be slow and the pH adjustment will take more time to happen. This slow response will cause an overfeed of lime or calcium sacharate which in turn will cause a pH increase to levels other than the correct one and will result in high color and high ash content in the final sugar product.

Further difficulties can arise when this syrup is then passed to the evaporator systems. These systems are usually in a series of vessels each of which has a greater vacuum than the previous one. This process will concentrate the sugar juice even further. The use of phosphoric acid and other phosphate compounds in the clarification stage can cause scaling problems in the evaporation stage. The high phosphate concentration, when concentrated even more in the evaporation stage can crystallize and precipitate out causing deposition in the evaporative stage.

The present inventors have discovered a novel precoagulant composition that reduces the amount of phosphate employed and reduces the amount of scale formed in the evaporation stage of the sugar making process.

DETAILED DESCRIPTION OF THE INVENTION

The present invention provides for an improved process for clarifying sugar syrup during the production of sugar. The method comprises adding to the sugar syrup during precoagulation an effective amount of a composition comprising a condensation polymer and a phosphate compound.

The condensation polymer is derived from the condensation polymerization of epichlorohydrin or a dihalo alkyl compound with a dialkylamine wherein the alkyl groups of the dialkylamine have from 1 to about 5 carbon atoms. Exemplary dialkylamines include dimethylamine, diethylamine, dipropylamine, dibutylamine, and dipentylamine. Preferably, the dialkylamine is dimethylamine or diethylamine. A preferred embodiment of this polymer may be derived from the condensation polymerization of epichlorohydrin with dimethylamine, with a molecular weight from about 8,000 to about 14,000.

Representative phosphate compounds include but are not limited to the halogen salts such as phosphorous trichloride; tripolyphosphates, pyrophosphates, hexametaphosphates, and trisodium phosphates. Any phosphate salt that is water soluble and will not substantially decrease the pH of the sugar syrup is expected to be within the purview of this invention. Preferably, the phosphate based compound is food grade sodium tripolyphosphate such as those commercially available from Monsanto as NUTRIPHOS 0-88 and Albright and Wilson as ALBRIPHOS 50F.

The inventive method takes place in the flotation or clarification system of the sugar making system. The sugar syrup is passed to the flotation system where the sugar syrup is coagulated or pre-coagulated prior to the syrup being passed to the crystallization phase of the white sugar production process.

The sugar syrup can be defined as a colloidal suspension composed of different types and sizes of particles. Table A illustrates the general composition of this syrup according to particle diameter.

TABLE A

| Dispersion | Diameter ($\mu$) | Weight (%) | Types |
|---|---|---|---|
| Rude | D > 1 | 2–5 | Small baggass particles, sand |
| Colloidals | 0.001 < D < 1 | 0.05–0.3 | Waxes, greases, proteins, gums, colorants, dextranes |
| Moleculars and Ionics | D < 0.001 | 8–21 | Sugars: sucrose, glucose, fructose, manose<br>Mineral salts: K, Ca, Mg and Na sulfates, chlorides, silicates and phosphates<br>Organic acids: aconitic, oxalic, malic, etc. |

The coagulation of these impurities is important in achieving the final product of finished white sugar. According to Stoke's Law, the tendency of particles to coagulate is inversely proportional to the square of its diameter. Since 8 to 21% by weight of the sugar syrup juice is composed of particles smaller than 0.001 micron, the sugar syrup juice coagulation process does not follow Stoke's Law, but is driven by Zeta potential. Zeta potential is the electric charge acquired by a particle in a liquid suspension. The closer to zero this potential is, the better the coagulation is going to be. Table B illustrates stability characteristics versus Zeta potential.

TABLE B

| Stability Characteristics | Zeta Potential (mV) |
|---|---|
| Maximum agglomeration and precipitation | +3 to 0 |
| Excellent agglomeration and precipitation | −1 to −4 |
| Weak agglomeration and precipitation | −5 to −10 |
| Very weak agglomeration | −11 to −20 |
| Weak stability (only some agglomerates) | −21 to −30 |
| Moderate stability (no agglomerates) | −31 to −40 |
| Good stability | −41 to −50 |
| Very good stability | −51 to −60 |
| Excellent stability | −61 to −80 |
| Maximum stability | −81 to −100 |

For purposes of the present invention, the phrase "effective clarifying amount" is defined as that amount of condensation polymer and phosphate compound which will clarify the sugar syrup. Preferably, this ranges from about 50 parts of the composition to about 250 parts per million parts of sugar syrup.

The weight ratio of condensation polymer to phosphate compound is generally in the range of about 10 to about 5 with a weight ratio of about 2 to about 1 preferred.

The inventive composition may be added to the sugar syrup as a combination or as individual ingredients. Preferably the composition is added to the sugar syrup prior to its arrival in the flotation system, but may also be added directly to the syrup in the flotation system.

The invention will now be described with reference to a number of specific examples, which should not be considered as limiting the scope of the claimed invention.

EXAMPLES

Testing was performed to measure lime reduction using neutral phosphate sources in comparison to phosphoric acid. 200 ml of sugar syrup was transferred to a 500 ml beaker. This syrup has a density of 1.085 g/cm$^3$, a brix of 21.5, an original ICUMSA IV number of 9182 and a pH of 5.0.

The temperature of the sucrotest device was first adjusted to 85° C. and mixed strongly for about 1 minute.

The syrup was then transferred to the sucrotest graduated tube while the anionic polymer solution was simultaneously added. The tube was then capped and the agitation and air injection was begun at 65 to 70 rpm for 1 minute.

The size of the formed flakes and flotation velocity was observed. After 20 minutes, a sample was taken and diluted to 10° brix. This sample was filtered through a 47 $\mu$ Millipore membrane under vacuum. The absorbance and the transmittance of the filtered sample were measured at 420 nm wave length.

The ICUMSA IV color was calculated using the formula:

$$ICUMSA\ IV\ Color = \frac{\text{Absorbance} \times 1000}{\frac{\text{Brix}}{100} \times \text{density} \times \text{cuvet width}}$$

where: Density=density of filtered diluted syrup sample

Brix=brix of the filtered diluted syrup sample

Cuvet width=1.0 cm

The results of this testing are presented in Table I. The higher the percent transmittance, the better the clarification of the syrup.

TABLE I

Clarification of Sugar Syrup
pH = 7 at 100° C.
No $SO_2$ oxidant

| Test | Lime (mL/L) | Pre-Coagulant (ppm) | Anionic Coagulant (ppm) | ABS (420 nm) | Trans (%) | ICUMSA IV Color |
|---|---|---|---|---|---|---|
| 1 | 5.5 | — | 2.0 | 0.6070 | 24.7 | 5848 |
| 2 | 4.2 | A (50) | 2.0 | 0.5310 | 30.6 | 5116 |
| 3 | 4.0 | B (250) | 2.0 | 0.4535 | 35.8 | 4369 |

Precoagulant A is sodium tripolyphosphate
Precoagulant B is 20% dimethylamine-epichlorohydrin copolymer and 10% sodium tripolyphosphate, by weight, in water These results demonstrate that the inventive composition is more effective than the use of just a phosphate compound at clarifying the sugar syrup while reducing the overall amount of phosphate containing compound employed.

Further testing was performed in the sucrotest device. These results are presented in Table II.

TABLE II

Clarification of Sugar Syrup
pH = 7 at 100° C.
No $SO_2$ Oxidant
2.0 ppm of Anionic Polymer

| Test | Lime (mL/L) | Pre-Coagulant (ppm) | ABS (420 nm) | Trans (%) | ICUMSA IV Color |
|---|---|---|---|---|---|
| 1 | 5.5 | — | 0.6070 | 24.7 | 5848 |
| 2 | 5.0 | A (50) | 0.5795 | 28.4 | 5583 |
| 3 | 5.0 | B (50) | 0.5130 | 31.5 | 4942 |
| 4 | 5.0 | A (100) | 0.5415 | 29.7 | 5217 |
| 5 | 4.3 | B (100) | 0.5135 | 31.3 | 4947 |
| 6 | 4.0 | A (150) | 0.5230 | 30.2 | 5039 |
| 7 | 3.8 | B (150) | 0.4530 | 35.5 | 4364 |
| 8 | 3.8 | A (200) | 0.5460 | 30.2 | 5260 |
| 9 | 3.5 | B (200) | 0.4040 | 39.6 | 3892 |
| 10 | 3.3 | A (250) | 0.4650 | 34.5 | 4480 |
| 11 | 3.3 | B (250) | 0.3840 | 41.1 | 3699 |

A is sodium tripolyphosphate
B is 20% dimethylamine-epichlorohydrin copolymer and 10% sodium tripolyphosphate, by weight, in water As seen in Table II, the inventive composition was more effective than the phosphate containing compound at producing a more clarified sugar solution from a range of 50 to 250 ppm active.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A method for clarifying sugar syrup during production of sugar comprising adding to said syrup an effective clarifying amount of a composition of a condensation polymer of a dihaloalkyl compound and a dialkylamine compound and a phosphate compound, the phosphate compound comprising at least one water soluble compound which does not substantially decrease the pH of the sugar syrup.

2. The method as claimed in claim 1 wherein said dialkylamine compound comprises at least one of dimethylamine, diethylamine, dipropylamine, dibutylamine, and dipentylamine.

3. The method as claimed in claim 1 wherein said dihaloalkyl is epichlorohydrin.

4. The method as claimed in claim 1 wherein said condensation polymer is derived from the polymerization of epichlorohydrin and dimethylamine.

5. The method as claimed in claim 4 wherein said condensation polymer has a molecular weight ranging from about 8000 to about 14,000.

6. The method as claimed in claim 1 wherein said phosphate compound comprises at least one of halogen salts of phosphorous; tripolyphosphates; pyrophosphates; hexametaphosphates; and trisodium phosphates.

7. The method as claimed in claim 6 wherein said phosphate compound is sodium tripolyphosphate.

8. The method as claimed in claim 7 wherein said sodium tripolyphosphate is food grade.

9. The method as claimed in claim 1 wherein said sugar syrup is in a flotation or clarification system of a sugar making system.

10. The method as claimed in claim 1 wherein said sugar syrup is derived from cane sugar.

11. The method as claimed in claim 1 wherein said composition is added to said sugar syrup in an amount ranging from about 50 parts to about 250 parts per million parts sugar syrup.

12. The method as claimed in claim 1 wherein the weight ratio of condensation polymer to phosphate compound ranges from about 2 to about 1.

13. A composition useful in clarifying sugar syrup comprising a condensation polymer of a dihaloalkyl compound and a dialkylamine compound and a phosphate compound, said phosphate compound comprising at least one water soluble compound which does not substantially decrease the pH of the sugar syrup.

14. The composition as claimed in claim 13 wherein said dialkylamine compound comprises at least one of dimethylamine, diethylamine, dipropylamine, dibutylamine, and dipentylamine.

15. The composition as claimed in claim 14 wherein said dihaloalkyl is epichlorohydrin.

16. The composition as claimed in claim 13 wherein said condensation polymer is derived from the polymerization of epichlorohydrin and dimethylamine.

17. The composition as claimed in claim 16 wherein said condensation polymer has a molecular weight ranging from about 8,000 to about 14,000.

18. The composition as claimed in claim 13 wherein said phosphate compound comprises at least one of halogen salts of phosphorous; tripolyphosphates; pyrophosphates; hexametaphosphates; and trisodium phosphates.

19. The composition as claimed in claim 18 wherein said phosphate compound is sodium tripolyphosphate.

20. The composition as claimed in claim 19 wherein said sodium tripolyphosphate is food grade.

* * * * *